US007340811B2

(12) United States Patent
Anderson et al.

(10) Patent No.: US 7,340,811 B2
(45) Date of Patent: Mar. 11, 2008

(54) PIVOTING CASKET CARRIER

(75) Inventors: Richard C. Anderson, Grand Blanc, MI (US); Robert Lindholme, Rock Island, IL (US); Fred Bowers, East Moline, IL (US)

(73) Assignee: Department of Veterans Affairs, Washington, DC (US)

( * ) Notice: Subject to any disclaimer, the term of this patent is extended or adjusted under 35 U.S.C. 154(b) by 334 days.

(21) Appl. No.: 11/147,240

(22) Filed: Jun. 8, 2005

(65) Prior Publication Data

US 2005/0278910 A1 Dec. 22, 2005

Related U.S. Application Data

(60) Provisional application No. 60/580,383, filed on Jun. 18, 2004.

(51) Int. Cl.
*A61G 17/00* (2006.01)

(52) U.S. Cl. ..... 27/27; 296/16; 414/533

(58) Field of Classification Search ..... 27/27; 296/16–18; 211/85.16; 280/640; 414/522, 414/533

See application file for complete search history.

(56) References Cited

U.S. PATENT DOCUMENTS 1,242,221 A 10/1917 Madison, Jr.
1,893,739 A 1/1933 Harris
2,010,860 A 8/1935 Jacobs
2,085,043 A * 6/1937 Richter ..... 414/522
2,196,265 A * 4/1940 Krogh ..... 414/522
2,229,483 A * 1/1941 Toulmin, Jr. ..... 414/522
2,454,566 A * 11/1948 Pfeiffer ..... 414/522
2,573,496 A * 10/1951 Runkle ..... 414/522
2,666,666 A * 1/1954 Schneider et al. ..... 296/16
2,667,295 A 1/1954 Johnston et al.
3,155,417 A 11/1964 Hanselman
3,561,625 A * 2/1971 Dioguardi et al. ..... 414/533
3,757,972 A 9/1973 Martin

FOREIGN PATENT DOCUMENTS

JP 03-262739 11/1991

* cited by examiner

*Primary Examiner*—William L. Miller
(74) *Attorney, Agent, or Firm*—Dykema Gossett PLLC

(57) ABSTRACT

A pivoting casket carrier incoludes a pivoting bed having a predefined length and width. The bed includes a plurality of rollers disposed substantially transverse to the length of the bed for facilitating removal and placement of a casket on the bed. A pivoting mechanism is operatively connected to the bed to allow a predetermined degree of rotation of the bed about a central axis of the pivoting mechanism. A locking system is operatively coupled to the pivoting mechanism to enable operation of the pivoting mechanism to allow rotation of the bed when the locking system is in a first disengaged position, and disable operation of the pivoting mechanism to prevent rotation of the bed when the locking system is in a second engaged position.

12 Claims, 4 Drawing Sheets

PIVOTING CASKET CARRIER

CROSS-REFERENCE TO RELATED APPLICATIONS

This application claims the benefit of U.S. Provisional Patent Application No. 60/580,383 filed Jun. 18, 2004, hereby incorporated by reference in its entirety.

BACKGROUND OF INVENTION a. Field of Invention

The invention relates generally to casket carriers, and, more particularly to a pivoting casket carrier for facilitating easy loading and unloading of caskets from a pivotable transport bed of a casket transport vehicle.

b. Description of Related Art

In the art, there presently exist a variety of devices for loading and unloading of caskets or other similar units from a transport bed of an automobile.

Known casket and related unit carriers are disclosed for example in U.S. Pat. Nos. 3,155,417, 3,757,972, 2,010,860, 1,242,221, 1,893,739 and 2,667,295, the respective disclosures of which are incorporated herein by reference, and Japanese Publication No. 3-262739.

Of the aforementioned U.S. and Japanese Patents, U.S. Pat. No. 3,155,417 ('417 patent), discloses a locking mechanism for a casket table having a plurality of rollers for enabling smooth placement and removal of a casket from the carrier bed. As shown in FIG. 1 of the '417 patent, casket table 12 may be rotated along tracks 32 or 34 (shown in dotted lines in a transverse position) for enabling placement of a casket thereon. Once a casket is disposed on table 12, the table may be completely inserted into hearse 10, and thereafter, table 12 may be locked in place by means of locking mechanism 36 in the neutral position (shown in solid lines in FIG. 1). Although somewhat functional, the casket table of the '417 patent is problematic due to the relatively complicated pivotal and sliding operation of the table, as well as the complicated operation of the pivoting and locking mechanisms disclosed therein. Moreover, as readily evident, the provision of the tracks, as well as the numerous components required for adequate operation of the locking mechanism render the casket table of '417 patent susceptible to a variety of maintenance and reliability problems.

U.S. Pat. No. 3,757,972 ('972 patent), discloses a pivotable vehicle carrier assembly including a pivotable bed which is allowed to pivot by means of a plurality of ball bearings disposed in the bed frame structure (see FIG. 4). As discussed above for the '417 patent, the vehicle carrier assembly of the '972 patent is problematic due to the relatively complicated operation of the pivoting mechanism disclosed therein, which renders the carrier assembly of the '972 patent susceptible to a variety of maintenance and reliability problems.

U.S. Pat. No. 2,010,860 ('860 patent), discloses a pivotable casket carrier assembly including a pivotable bed which is allowed to pivot by means of a conventional pin-type pivot 21 (see FIG. 2), and positioned transversely for placement and removal of a casket by rotation of a worm gear/follower mechanism. As discussed above for the '417 and '972 patents, the pivotable casket carrier assembly of the '860 patent is problematic due to the relatively complicated pivotal and sliding operation of the table, as well as the complicated operation of the pivoting and locking mechanisms disclosed therein. Moreover, in virtually an identical manner as the '417 patent, the provision of the worm gear/follower mechanism renders the casket carrier of the '860 patent susceptible to a variety of maintenance and reliability problems.

Lastly, U.S. Pat. No. 1,242,221 ('221 patent) discloses a pivotable casket carrier assembly including a pivotable bed which is allowed to pivot by means of a plurality of ball bearings disposed in the bed frame structure. Additionally, the '221 patent discloses a locking mechanism including a sliding locking bolt disposed in a keeper fixed on the carrier bed. As discussed above for the '417, '972 and '860 patents, the pivotable casket carrier assembly of the '221 patent is problematic due to the inadequate operation of the locking mechanism.

It would therefore be of benefit to provide a pivotable casket carrier which is simple in operation and requires minimal maintenance for adequate and continued operation. It would also be of benefit to provide a pivotable casket carrier which is robust and cost-effective in design, and which is simple and economical to manufacture.

SUMMARY OF INVENTION

The invention solves the problems and overcomes the drawbacks and deficiencies of prior art casket carriers by providing a pivotable casket carrier which is simple in operation, yet robust in design so as to require minimal maintenance for adequate and continued operation.

The invention thus provides a pivoting casket carrier for facilitating easy loading and unloading of caskets from a transport bed. The casket carrier may include an enclosed bed that rotates 90° to the right or left for facilitating easy loading and unloading of caskets from a multi-roller mounted bed. The purpose of the pivoting casket carrier is to transport a casket from the cemetery funeral grounds to the grave site in a self-contained vehicle that can travel down the small rows of grave markers without disturbing the grounds. Upon reaching the grave site, the bed containing the casket can be rotated approximately 90° to the right or left to allow the casket to be rolled out of the covered bed into a lowering device without any special maneuvering of the casket carrying vehicle.

In the exemplary embodiment disclosed, the carrier generally includes a mounting frame assembly for attachment thereof onto a yard maintenance vehicle. The mounting frame assembly may include a plurality of holes at a central location thereof for mounting a hub for enabling rotation of the carrier. The hub may be notched at predetermined intervals for enabling locking thereof by means of a locking bar, and thereby enabling predetermined orientation of the carrier along the intervals. The carrier may further include rollers along the carrier bed for enabling smooth placement and removal of a casket from the carrier bed. A canopy may be provided for covering a casket during transport.

The pivoting casket carrier may thus include a pivoting bed having a predefined length and width. The bed may include a plurality of rollers disposed substantially transverse to the length of the bed for facilitating removal and placement of a casket on the bed. A pivoting mechanism may be operatively connected to the bed to allow a predetermined degree of rotation of the bed about a central axis of the pivoting mechanism. A locking system may be operatively coupled to the pivoting mechanism to enable operation of the pivoting mechanism to allow rotation of the bed when the locking system is in a first disengaged position, and disable operation of the pivoting mechanism to prevent rotation of the bed when the locking system is in a second engaged position.

For the pivoting casket carrier described above, the pivoting mechanism may include a hub connected at a central widthwise location on the bed for allowing rotation of the bed. The hub may include a rod extending therefrom, the rod being disposed in a plurality of holes in a mounting frame assembly connected to a vehicle including the pivoting casket carrier mounted thereon to enable free rotation of the rod and thereby the hub. The hub may also include a plurality of radial notches. The locking system may include a reciprocable locking bar, the locking bar being engageable with one of the notches to prevent rotation of the bed and further being disengageable from the notches to allow rotation of the bed. The locking bar may be spring biased for engagement with one of the notches. The pivoting casket carrier may further include a casket cover disposed on the pivoting bed to substantially enclose the pivoting bed.

The invention also provides a pivoting casket carrier including a pivoting bed having a predefined length and width. The bed may include means for facilitating removal and placement of a casket on the bed. Pivoting means may be operatively connected to the bed to allow a predetermined degree of rotation of the bed. Locking means may be operatively coupled to the pivoting means to enable operation of the pivoting means to allow rotation of the bed when the locking means is in a first disengaged position, and disable operation of the pivoting means to prevent rotation of the bed when the locking means is in a second engaged position.

For the pivoting casket carrier described above, the pivoting means may be a hub connected at a central widthwise location on the bed for allowing rotation of the bed. The hub may include a rod extending therefrom, the rod being disposed in a plurality of holes in a mounting frame assembly connected to a vehicle including the pivoting casket carrier mounted thereon to enable free rotation of the rod and thereby the hub. The hub may include a plurality of radial notches. The locking means may be a reciprocable locking bar, the locking bar being engageable with one of the notches to prevent rotation of the bed and further being disengageable from the notches to allow rotation of the bed. The locking bar may be spring biased for engagement with one of the notches. The pivoting casket carrier may further include a casket cover disposed on the pivoting bed to substantially enclose the pivoting bed.

The invention also provides a vehicle including a pivoting casket carrier mounted thereon. The vehicle may include a pivoting bed having a predefined length and width. The bed may include a plurality of rollers disposed substantially transverse to the length of the bed for facilitating removal and placement of a casket on the bed. A pivoting mechanism may be operatively connected to the bed to allow a predetermined degree of rotation of the bed about a central axis of the pivoting mechanism. A locking system may be operatively coupled to the pivoting mechanism to enable operation of the pivoting mechanism to allow rotation of the bed when the locking system is in a first disengaged position, and disable operation of the pivoting mechanism to prevent rotation of the bed when the locking system is in a second engaged position.

For the vehicle described above, the pivoting mechanism may include a hub connected at a central widthwise location on the bed for allowing rotation of the bed. The hub may include a rod extending therefrom, the rod being disposed in a plurality of holes in a mounting frame assembly connected to the vehicle including the pivoting casket carrier mounted thereon to enable free rotation of the rod and thereby the hub. The hub may also include a plurality of radial notches. The locking system may include a reciprocable locking bar, the locking bar being engageable with one of the notches to prevent rotation of the bed and further being disengageable from the notches to allow rotation of the bed. The locking bar may be spring biased for engagement with one of the notches. The pivoting casket carrier may further include a casket cover disposed on the pivoting bed to substantially enclose the pivoting bed.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENT

Figure 1:
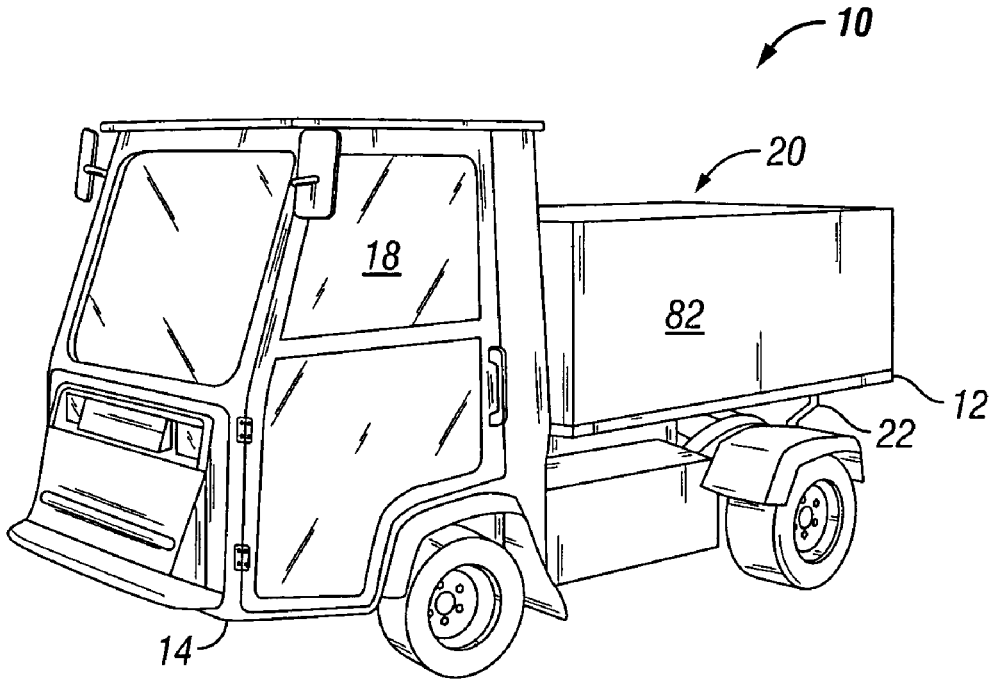
FIG. 1 is an illustrative perspective view of a vehicle including a pivoting casket carrier according to the present invention mounted thereon, the casket carrier being disposed in a longitudinal traveling configuration.
Figure 2:
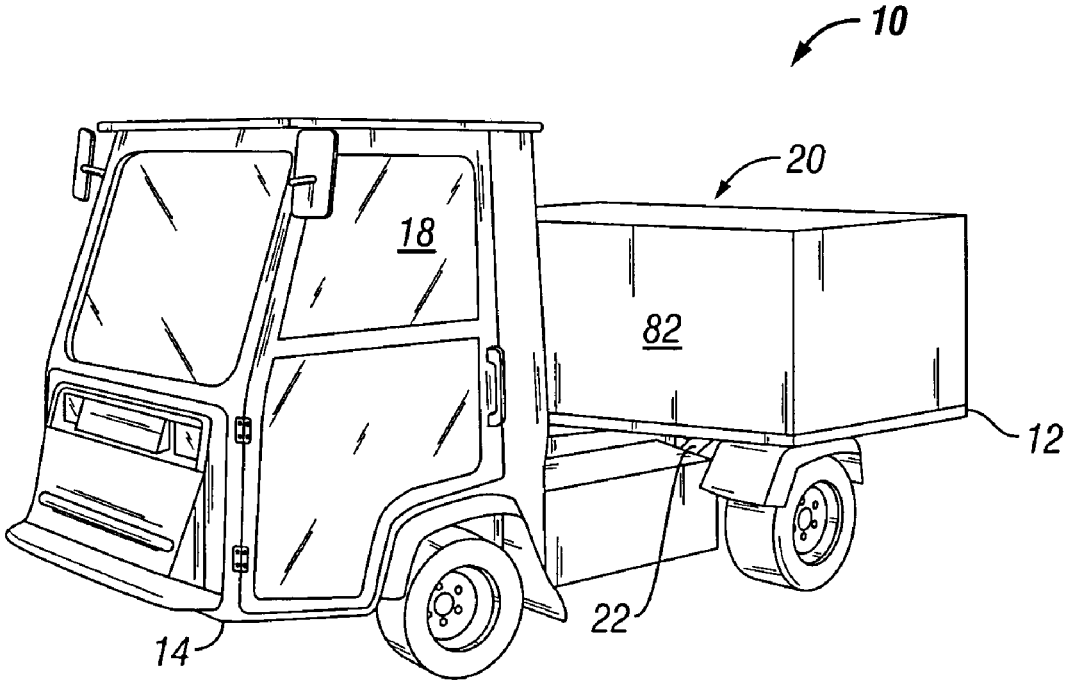
FIG. 2 is an illustrative perspective view of the vehicle of FIG. 1, the casket carrier being disposed in a rotated unloading configuration.
Figure 3:
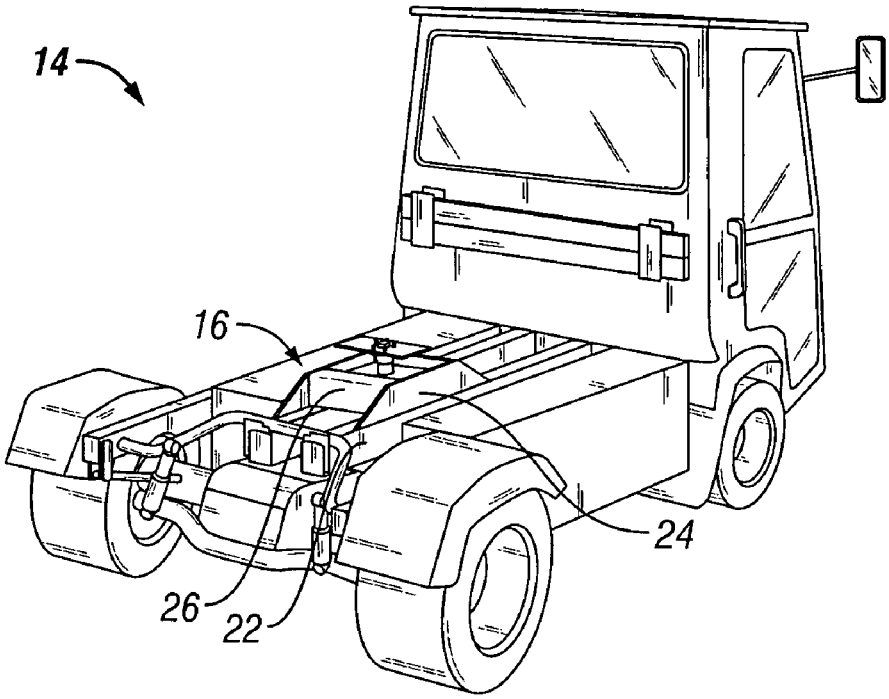
FIG. 3 is a perspective view illustrative of the mounting frame assembly for mounting the pivoting casket carrier onto the vehicle of FIG. 1.
Figure 4:
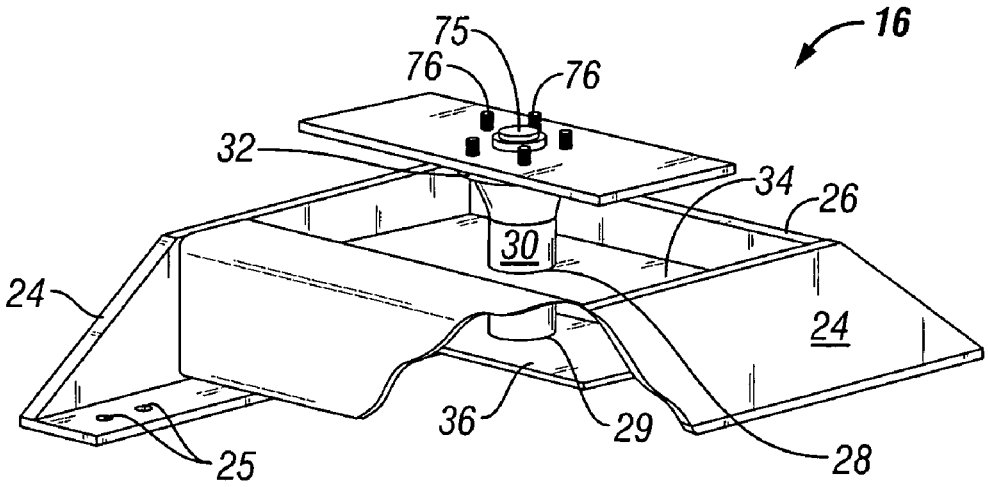
FIG. 4 is an enlarged perspective view illustrative of a hub/rod assembly rotatably disposed within apertures provided in the transverse brace of the mounting frame assembly.
Figure 5:
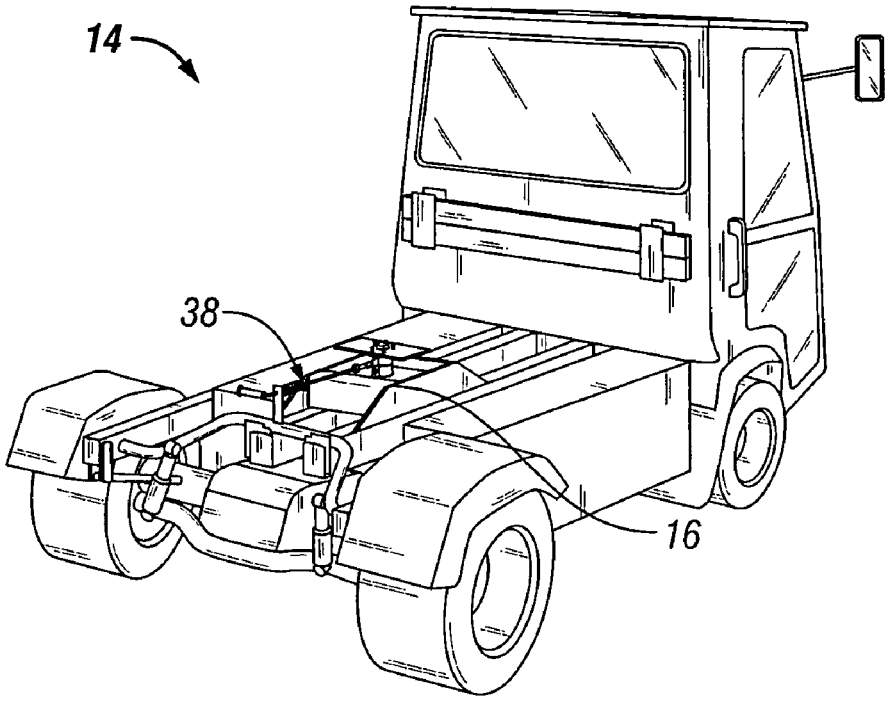
FIG. 5 is a perspective view illustrative of the locking system for the pivoting casket carrier of FIG. 1.
Figure 6:
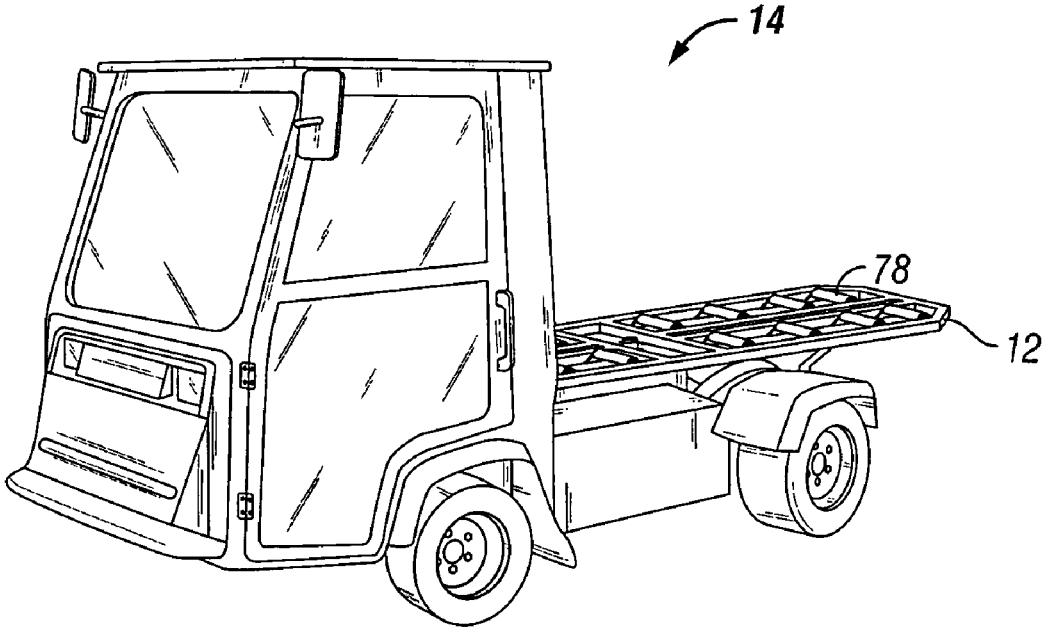
FIG. 6 is a perspective view illustrative of the pivoting bed for the pivoting casket carrier of FIG. 1, the bed being mounted on the vehicle of FIG. 1.

Referring now to the drawings wherein like reference numerals designate corresponding parts throughout the several views, FIGS. 1-8 illustrate a pivoting casket carrier according to the present invention, generally designated 10.

Generally, the present invention is directed to a pivoting casket carrier 10 having an enclosed bed that rotates 90° or at other predefined increments to the right or left for facilitating easy loading and unloading of caskets from a multi-roller mounted bed. The purpose of pivoting casket carrier 10 is to transport a casket from the cemetery funeral grounds to the grave site in a self-contained vehicle that can travel down the small rows of grave markers without disturbing the grounds. Upon reaching the grave site, the bed containing the casket can be rotated as needed to the right or left to allow the casket to be rolled out of the covered bed into a lowering device without any special maneuvering of the casket carrying vehicle.

Referring to FIGS. 1-4, pivoting casket carrier 10 generally includes a pivotable bed 12 mounted on a vehicle 14 by means of mounting frame assembly 16. As shown, vehicle 14 may be similar to a TORO yard maintenance truck, or a similarly sized vehicle designed for traveling down the small rows of grave markers in a cemetery. Vehicle 14 may generally include an operator cab 18 for allowing a single operator to enter and operate the vehicle as needed to maneuver the same through a cemetery. Vehicle 14 may further include a rear cargo area 20 having a frame structure 22 onto which mounting frame assembly 16 may be fixedly attached by means of bolts (not shown), welding or the like.

Still referring to FIGS. 1-4, mounting frame assembly 16 may generally include a pair of mirror image opposite side supports 24 mounted substantially parallel to the lengthwise direction of the vehicle. A transverse brace 26 may be welded or otherwise joined to each side support 24 for providing a rigid platform for mounting of pivoting bed 12. Side supports 24 may include a plurality of holes 25 for insertion of bolts (not shown) for attachment of supports 24 onto frame structure 22. An aperture 28 may be disposed generally centrally in upper surface 34 connected to transverse brace 26 for insertion of rod 30 of hub 32 (see FIGS. 4 and 7). In the particular embodiment illustrated, hub 32 may have a 3750 lb load capacity. In addition to upper surface 34, brace 26 may include lower surface 36 having aperture 29 coaxial with aperture 28 so that rod 30 projects through each of the apertures and is thereby held in an upright configuration. The provision of the upper and lower surface 34, 36, respectively, also provides a rest and support area for rod 30 to thereby allow free rotation of hub 32 and rod 30 disposed within apertures 28, 29.

Figure 7:
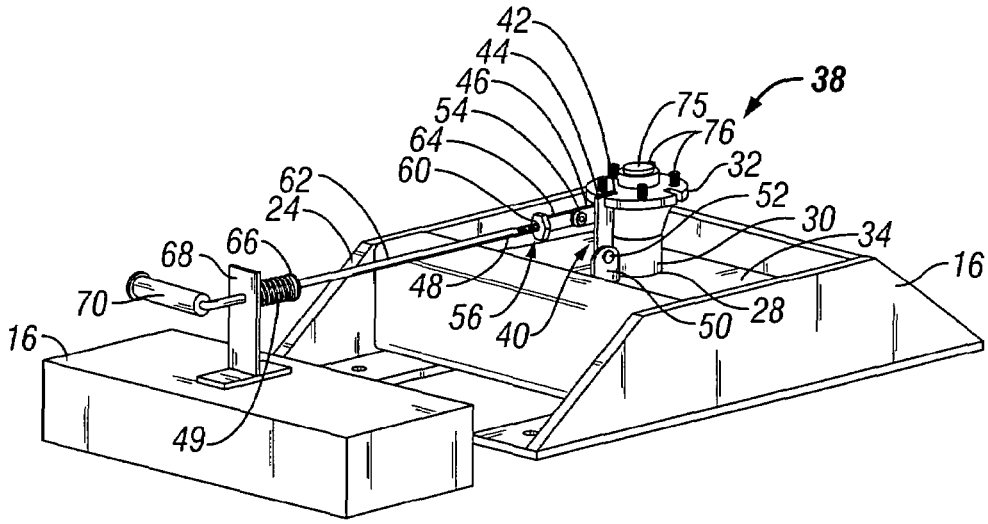
FIG. 7 is an enlarged perspective view of the locking system for the pivoting casket carrier of FIG. 1.

Turning next to FIGS. 1, 2, 4, 5 and 7, locking system 38 for casket carrier 10 may generally include a locking mechanism 40 operative in conjunction with hub 32. As shown in FIG. 7, hub 32 may include a plurality of notches 42, and in the particular embodiment shown, four notches 42 may be provided at 90° intervals about the circumference of hub 32. As would be apparent to those skilled in the art, additional notches 42 may be provided at 45° or 30° intervals, for example, for further controlling and limiting pivotal movement of bed 12, as will be described in further detail below.

Locking mechanism 40 may generally include first, second the third linkages 44, 46, 48, respectively. Linkage 44 may be pivotally mounted to fixed connection 50 by means of a hinged pin connection 52, and fixed connection 50 may be attached to upper surface 34 connected to brace 26 by means of bolts, welding or the like. Linkage 44 may be further fixedly mounted to linkage 46 (or formed therewith), which may be pivotally mounted to adjustable linkage 48 by means of a hinged pin connection 54. As shown in FIG. 7, linkage 48 may be adjustable by means of a conventional nut/bolt type connection 56 which allows the length of linkage 48 to be increased or decreased by rotation of bolt 60 in a locking direction relative to section 62 of linkage 48. Further, in order to facilitate disassembly of the components of locking mechanism 40, bolt 60 may be rotated in an opposite unlocking direction to disassemble sections 64 and 62. The opposite end of linkage 48 may include a helical spring 49 having opposing ends disposed against spring seat 66 and handle brace 68. Brace 68 may be attached to a component of mounting frame assembly 16 by means of bolts, welding or the like. Brace 68 may further include an aperture having section 62 of linkage 48 disposed therethrough. A handle 70 may be provided at a generally 90° angle relative to section 62 of linkage 48 for operating locking mechanism 40, as described in greater detail below.

Figure 8:
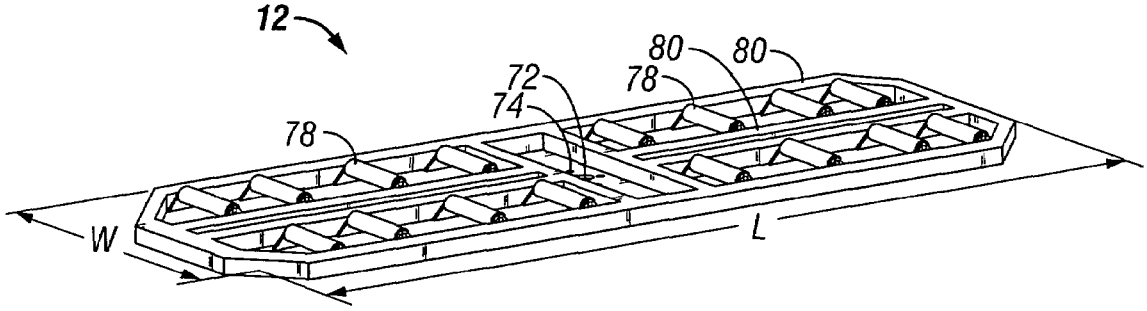
FIG. 8 is an enlarged perspective view of the pivoting bed for the pivoting casket carrier of FIG. 1.

Referring next to FIGS. 1, 2, 6 and 8, pivotable bed 12 may generally include a length L and width W dimensioned to adequately support a casket. Bed 12 may include an aperture 72 disposed at a generally widthwise central location. A plurality of holes 74 may be provided at fixed radial and angular locations corresponding to lugs 76 such that when assembled, lugs 76 enter through holes 74, and alignment rod 75 of hub 32 protrudes through aperture 72. Bed 12 may further include a plurality of rollers 78 for facilitating placement and removal of a coffin thereon. As shown in FIG. 8, rollers 78 may be mounted along side rails 80, and the diameter and spacing of rollers 78 may be determined by testing of casket carrier 10, as apparent to those skilled in the art.

With reference to FIGS. 1-8, the operation of pivoting casket carrier 10 will now be described in detail.

Specifically, as shown in FIG. 1, with a casket placed on pivoting bed 12 within enclosure 82, as discussed above, vehicle 14 may be driven through the grassy areas between the rows of headstones to the open gravesite in a cemetery, without unwanted damage to the grounds. Upon reaching a selected gravesite, vehicle 14 may be stopped at the site and bed 12 may be unlocked and rotated in either direction by means of locking system 38. Specifically, handle 70 of locking system may be pulled to release the angular edge of locking mechanism 40, formed by linkages 44 and 46, from within the associated notch 42 in hub 32. With locking mechanism 40 released, bed 12 may be rotated as needed to the 90° rotated orientation shown in FIG. 2. As discussed above, for a hub having additional notches 42 provided at 45° or 30° intervals, bed 12 may be rotated as needed for additional orientational control thereof. After unloading the casket from within enclosure 82, bed 12 may be rotated back to its original position of FIG. 1 by pulling handle 70 of locking system 38 to allow rotation of hub 32. Thereafter, vehicle 14 may driven out from the grassy areas between the rows of headstones as needed for transportation of additional caskets.

Based upon the discussion above, pivoting casket carrier 10 thus eliminates the use of much large hearses, vans, and other large vehicles that have a tendency of damaging the well manicured grounds. Pivotable casket carrier 10 also provides for simple operation for loading and unloading caskets, and requires minimal maintenance for adequate and continued operation.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A pivoting casket carrier comprising:

a pivoting bed having a predefined length and width, said bed includes a plurality of rollers disposed substantially transverse to the length of said bed for facilitating removal and placement of a casket on said bed;

a pivoting mechanism operatively connected to said bed to allow a predetermined degree of rotation of said bed about a central axis of said pivoting mechanism; and a locking system operatively coupled to said pivoting mechanism to enable operation of said pivoting mechanism to allow rotation of said bed when said locking system is in a first disengaged position, and disable operation of said pivoting mechanism to prevent rotation of said bed when said locking system is in a second engaged position, wherein said pivoting mechanism includes a hub connected at a central widthwise location on said bed for allowing rotation of said bed, and wherein said hub includes a rod extending therefrom, said rod being disposed in a plurality of holes in a mounting frame assembly connected to a vehicle including said pivoting casket carrier mounted thereon to enable free rotation of said rod and thereby said hub.

2. A pivoting casket carrier according to claim 1, further comprising a bed cover disposed on said pivoting bed to substantially enclose said pivoting bed.

3. A pivoting casket carrier comprising:

a pivoting bed having a predefined length and width, said bed includes a plurality of rollers disposed substantially transverse to the length of said bed for facilitating removal and placement of a casket on said bed;

a pivoting mechanism operatively connected to said bed to allow a predetermined degree of rotation of said bed about a central axis of said pivoting mechanism; and a locking system operatively coupled to said pivoting mechanism to enable operation of said pivoting mechanism to allow rotation of said bed when said locking system is in a first disengaged position, and disable operation of said pivoting mechanism to prevent rotation of said bed when said locking system is in a second engaged position, wherein said pivoting mechanism includes a hub connected at a central widthwise location on said bed for allowing rotation of said bed, wherein said hub includes a plurality of radial notches, said locking system includes a reciprocable locking bar, said locking bar being engageable with one of said notches to prevent rotation of said bed and further being disengageable from said notches to allow rotation of said bed.

4. A pivoting casket carrier according to claim 3, wherein said locking bar being spring biased for engagement with one of said notches.

5. A pivoting casket carrier comprising:

a pivoting bed having a predefined length and width, said bed includes means for facilitating removal and placement of a casket on said bed;

pivoting means operatively connected to said bed to allow a predetermined degree of rotation of said bed; and locking means operatively coupled to said pivoting means to enable operation of said pivoting means to allow rotation of said bed when said locking means is in a first disengaged position, and disable operation of said pivoting means to prevent rotation of said bed when said locking means is in a second engaged position, wherein said pivoting means is a hub connected at a central widthwise location on said bed for allowing rotation of said bed, and wherein said hub includes a rod extending therefrom, said rod being disposed in a plurality of holes in a mounting frame assembly connected to a vehicle including said pivoting casket carrier mounted thereon to enable free rotation of said rod and thereby said hub.

6. A pivoting casket carrier according to claim 5, further comprising a bed cover disposed on said pivoting bed to substantially enclose said pivoting bed.

7. A pivoting casket carrier comprising:

a pivoting bed having a predefined length and width, said bed includes means for facilitating removal and placement of a casket on said bed;

pivoting means operatively connected to said bed to allow a predetermined degree of rotation of said bed; and locking means operatively coupled to said pivoting means to enable operation of said pivoting means to allow rotation of said bed when said locking means is in a first disengaged position, and disable operation of said pivoting means to prevent rotation of said bed when said locking means is in a second engaged position, wherein said pivoting means is a hub connected at a central widthwise location on said bed for allowing rotation of said bed, wherein said hub includes a plurality of radial notches, said locking means is a reciprocable locking bar, said locking bar being engageable with one of said notches to prevent rotation of said bed and further being disengageable from said notches to allow rotation of said bed.

8. A pivoting casket carrier according to claim 7, wherein said locking bar being spring biased for engagement with one of said notches.

9. A vehicle including a pivoting casket carrier mounted thereon, said vehicle comprising:

a pivoting bed having a predefined length and width, said bed includes a plurality of rollers disposed substantially transverse to the length of said bed for facilitating removal and placement of a casket on said bed;

a pivoting mechanism operatively connected to said bed to allow a predetermined degree of rotation of said bed about a central axis of said pivoting mechanism; and a locking system operatively coupled to said pivoting mechanism to enable operation of said pivoting mechanism to allow rotation of said bed when said locking system is in a first disengaged position, and disable operation of said pivoting mechanism to prevent rotation of said bed when said locking system is in a second engaged position, wherein said pivoting mechanism includes a hub connected at a central widthwise location on said bed for allowing rotation of said bed, and wherein said hub includes a rod extending therefrom, said rod being disposed in a plurality of holes in a mounting frame assembly connected to said vehicle including said pivoting casket carrier mounted thereon to enable free rotation of said rod and thereby said hub.

10. A vehicle according to claim 9, further comprising a bed cover disposed on said pivoting bed to substantially enclose said pivoting bed.

11. A vehicle including a pivoting casket carrier mounted thereon, said vehicle comprising:

a pivoting bed having a predefined length and width, said bed includes a plurality of rollers disposed substantially transverse to the length of said bed for facilitating removal and placement of a casket on said bed;

a pivoting mechanism operatively connected to said bed to allow a predetermined degree of rotation of said bed about a central axis of said pivoting mechanism; and a locking system operatively coupled to said pivoting mechanism to enable operation of said pivoting mechanism to allow rotation of said bed when said locking system is in a first disengaged position, and disable operation of said pivoting mechanism to prevent rotation of said bed when said locking system is in a second engaged position, wherein said pivoting mechanism includes a hub connected at a central widthwise location on said bed for allowing rotation of said bed, wherein said hub includes a plurality of radial notches, said locking system includes a reciprocable locking bar, said locking bar being engageable with one of said notches to prevent rotation of said bed and further being disengageable from said notches to allow rotation of said bed.

12. A vehicle according to claim 11, wherein said locking bar being spring biased for engagement with one of said notches.

* * * * *